US005204201A

United States Patent [19]

Schank et al.

[11] Patent Number: 5,204,201

[45] Date of Patent: Apr. 20, 1993

[54] POLYMERIC SYSTEMS FOR OVERCOATING ORGANIC PHOTORECEPTORS USED IN LIQUID DEVELOPMENT XEROGRAPHIC APPLICATIONS

[75] Inventors: Richard L. Schank, Pittsford; John A. Bergfjord, Macedon, both of N.Y.

[73] Assignee: Xerox Corporation, Stamford, Conn.

[21] Appl. No.: 809,116

[22] Filed: Dec. 18, 1991

[51] Int. Cl.[5] ..... G03G 5/147; G03G 5/047

[52] U.S. Cl. ..... 430/59; 430/66; 430/67

[58] Field of Search ..... 430/58, 66, 67, 59

[56] References Cited

U.S. PATENT DOCUMENTS 4,407,920 10/1983 Lee et al. ..... 430/59

4,409,309 10/1983 Oka ..... 430/66 X

FOREIGN PATENT DOCUMENTS 2518510 12/1975 Fed. Rep. of Germany ..... 430/67

25747 3/1981 Japan ..... 430/67

80642 5/1983 Japan ..... 430/67

164955 6/1989 Japan ..... 430/59

39056 2/1990 Japan ..... 430/59

293756 12/1990 Japan ..... 430/66

*Primary Examiner*—Roland Martin

*Attorney, Agent, or Firm*—Kenyon & Kenyon

[57] ABSTRACT

An improved organic photoreceptor is disclosed which is coated with a clear polymer film to prevent aromatic amine transport molecule leakage and binder cracking when exposed to liquid toner developers. The polymer film may also be overcoated with a polysiloxane layer to provide additional abrasion resistance.

11 Claims, No Drawings

POLYMERIC SYSTEMS FOR OVERCOATING ORGANIC PHOTORECEPTORS USED IN LIQUID DEVELOPMENT XEROGRAPHIC APPLICATIONS

FIELD OF THE INVENTION

The present invention relates to organic photoreceptors for use in xerographic copying application. Particularly, the present invention relates to protective coatings for organic photoreceptors to provide protection from adverse effects of liquid developer/ink formulations on the photoreceptor surface.

BACKGROUND OF THE INVENTION

Organic photoreceptors, which utilize small transport molecules dispersed in a suitable binder, are currently widely used in many dry toner machine product lines offered by the xerographic copier industry. Most of these current photoreceptors, if not all, will fail under stress situations when liquid toner developers are used in place of the dry powder. For instance, organic photoreceptors incorporaing aromatic amine small transport molecules (e.g., N,N'-diphenyl-N,N'-bis(3-methylphenyl)-(1,1'-biphenyl)-4,4'-diamine) suffer extensive attack of the top transport layer by the developer solvent resulting in both leaching and binder cracking after only minutes of exposure time.

It is an object of the present invention to provide a polymeric system which when overcoated on an organic receptor surface will provide a protective barrier against the liquid developers/inks while at the same time not adversely affecting either the physical or electrical properties of the photoreceptor.

SUMMARY OF THE INVENTION

It has been determined that certain clear and transparent polymeric films, such as acrylates, in thick enough layers suppress the liquid ink leaching of the active transport molecule (e.g., N,N'-diphenyl-N,N'-bis(3-methylphenyl)-(1,1'-biphenyl)-4,4'-diamine) when coated on organic photoreceptors. In certain preferred embodiments the protective polymer layer is at least 3 micrometers thick to prevent small molecule leaching. More preferably, the protective layer is 5 micrometers or less in thickness to prevent development of lateral conductivity in the photoreceptor surface.

These protective plastic films can be used alone in most applications; but if additional wear and scratch protection is needed, an additional separate polysiloxane coating is preferably applied. Both combinations of materials provide an organic photoreceptor with an overcoat which is useful in liquid development systems, such as those known as "Landa inks", which often use isoparaffinic solvents, such as those in the $C_{10}$ to $C_{12}$ range.

In some instances, it is also necessary to provide a controlled degree of conductivity to both the plastic film and hard overcoat layers to prevent residual charge buildup during photoreceptor use. This is accomplished, for example, by adding compatible ionic quaternary salt compounds, such as trimethoxysilyl propyl-N,N,N-trimethyl ammonium chloride, to these layers in appropriate concentrations.

DETAILED DESCRIPTION OF PREFERRED EMBODIMENTS

Organic photoreceptors are well known in the art. Examples of organic photoreceptors are disclosed in U.S. Pat. No. 4,265,990, which is incorporated herein as if fully set forth. Examples of typical small transport molecules are disclosed in U.S. Pat. Nos. 4,806,443 and 4,818,650, which are incorporated herein as if fully set forth. Typical small transport molecules include: triphenylmethane, bis(4-diethylamine-2-methylphenyl)-phenylmethane; 4,40 ,4''-bis(diethylamino)-2',2''-dimethyltriphenylmethane; N,N'-bis(diethylamino)-(1,1'-biphenyl)-4,4'-diamine, wherein the alkyl is, for example, methyl, ethyl, propyl or N-butyl; and N,N'-diphenyl-N,N'-bis(3-methylphenyl)-(1,1'-biphenyl)-(4,4'-diamine.

The polymer layer can be made of any emulsion polymer material which is essentially transparent, colorless, unaffected by hydrocarbon solvents and which will suppress leaching of the small transport molecules (e.g., aromatic amines, such as N,N'-diphenyl-N,N'-bis(3-methylphenyl)-(1,1'-biphenyl)-4,4'-diamine) from the photoreceptor. The effectiveness of certain materials for this purpose may depend on the thickness at which the material is applied. As a result, the present invention is intended to encompass any polymer material which can suppress leaching of small transport molecules at a thickness which does not substantially impede performance of the photoreceptor. Examples of suitable materials include acrylates and saran type lattices. Polymers which are useful in practicing the present invention may include nonionic, cationic or anionic types. Preferably, the material is a crosslinked acrylic emulsion polymer, such as Dur-O-Cryl TM 720 (45% solids; self crosslinking, acrylic emulsion; pH 5.0; viscosity 300 cps; average particle size 0.2 microns; essentially nonionic; density 8.8 lb./gal.; commercially available from National Starch and Chemical Corp., Bridgewater, N.J.) or Dur-O-Cryl TM 820 (45% solids; self crosslinking, acrylic emulsion; pH 5.0; viscosity 200 cps; average particle size 0.2 microns; essentially nonionic; density 8.8 lb./gal.; commercially available from National Starch and Chemical Corp., Bridgewater, N.J.). Although acrylate polymers are preferred, other emulsion polymers can be used which are clear, transparent, conductive and insoluble in typical liquid developer solvents. Preferably, the protective polymer material does not attack the underlying photoreceptor layer.

Conductive additives used with these polymers must be water soluble and must not cause flocculation of the polymer emulsion. Examples of such conductive additives useful in nonionic or cationic systems include trimethylsilylpropyl-N,N,N-trimethyl ammonium chloride (such as that commercially available from Huls America Inc., Bristol, Pa.), benzyltriethylammonium chloride (such as that commercially available from Aldrich Chemical CO., Milwaukee, Wis.), Hyamine 1622 (commercially available from Lonza Inc., Fair Lawn, N.J.) and the like.

Since some polymer layers which suppress small transport molecule leaching may be susceptible to abrasion, it may be necessary to overcoat the polymer layer with a more scratch and abrasion resistant material. Although polysiloxane materials are preferred as the overcoat layer, any such polymeric material which will not significantly interfere with the performance of the photoreceptor can be used. Some suitable materials are described in U.S. Pat. No. 4,600,673, which is incorporated herein by reference. Preferred overcoat materials include SHC X1-2639 (polysiloxane; commercially available from Dow Corning) and Silvue ARC (polysiloxane; commercially available from SDC Coatings, Garden Grove, Calif.). The material used to form the overcoat layer may also include curing catalysts where suitable or necessary to the material employed.

In certain embodiments, the polymer layer and/or the additional overcoat layer contain an ionic quaternary salt to provide a controlled degree of conductivity. Any such salt which is miscible with these protective polymer materials and which provide the desired conductivity profile can be used, such as for example trimethoxysilyl propyl-N,N,N-trimethyl ammonium chloride.

The various layers used in practicing the present invention can be applied to appropriate surfaces in the manner usually used to apply such materials. Several embodiments of a photoreceptor of the present invention are described in the following example, which is intended to be illustrative and not limiting of the invention which is defined by the appended claims.

EXAMPLE I

A solution was made by mixing 1.0 g Dur-O-Cryl TM 720 (45% solids) and 0.3 g hydrolyzed $(MeO)_3Si(CH_2)_3N^+Me_3Cl^-$ (20% in a methanol/$H_2O$). The solution was applied onto a sample of organic photoreceptor (containing N,N'-diphenyl-N,N'-bis(3-methylphenyl)-(1,1'-biphenyl)-4,4'-diamine) using a #3 Mayer rod. The polymer layer was air dried and then oven dried for 30 minutes at 85° C. The resulting layer was stress tested against Isopar L (isoparaffinic solvent; boiling range 188°-207° C.; commercially available from Esso Corp.), which is the solvent used in Landa inks and is considered to be the major source of problems resulting from the use of liquid developers with organic photoreceptors. The prepared sample was bent over a 19 mm roll and exposed to Isopar L for 24 hours. Little or no leaching of the small transport molecule was observed. Also, no film cracking was observed. The coated sample was subjected to a flat plate electrical scan and produced the following values: $V_o=800$ V; $V_R=5$-10 V.

EXAMPLE II

A solution was made by mixing 10.0 g Dur-O-Cryl TM 720 (45% solids) (a self-crosslinking acrylic emulsion polymer commercially available from National Starch and Chemical Corp.), 15.0 g water and 5.0 g methanol. 1.0 g trimethoxysilyl propyl-N,N,N-trimethyl ammonium chloride (50% solids) was then added while stirring. The resulting mixture was then stirred for an additional 30 minutes at ambient temperature.

A silicone hard coat solution was prepared by mixing 1.0 g SHC X1-2639 (20% solids) (commercially availabe from Dow Corning), 1.0 g methanol, 0.1 g hydrolyzed trimethoxysilyl propyl-N,N,N-trimethyl ammonium chloride (20% solids), and 0.02 g A-1100 catalyst (commercially available from Union Carbide Corp.).

The acrylic solution was applied to a sample of organic photoreceptor (containing N,N'-diphenyl-N,N'-bis(3-methylphenyl)-(1,1'-biphenyl)-4,4'-diamine) using a #22 Mayer rod. The resulting layer was then oven dried for 30 minutes at 85° C. The hard coat solution was then applied to the dried acrylic layer using a #22 Mayer rod. The hard coat layer was air dried, then cured for 1 hour at 85° C.

The resulting coated photoreceptor was stress tested against Isopar L. The coated photoreceptor was bent over a 19 mm roll and exposed to Isopar L for 24 hours. Little or no small transport molecule leached from the sample. Also, no film cracking was observed.

The coated photoreceptor was subjected to a flat plate electrical scan and produced the following values: $V_o=850$ V (low dark decay); $V_R=10$ V.

EXAMPLE III

A solution was made by mixing 1.0 g Dur-O-Cryl TM 820 (45% solids) and 0.3 g hydrolyzed $(MeO)_3Si(CH_2)_3N^+Me_3Cl^-$ (20% in a methanol/$H_2O$). The solution was applied onto a sample of organic photorecptor (containing N,N'-diphenyl-N,N'-bis(3-methylphenyl)-(1,1'-biphenyl)-4,4'-diamine) using a #5 Mayer rod. The polymer layer was air dried and then oven dried for 30 minutes at 85° C. The resulting layer was then stress tested against Isopar L. The prepared sample was bent over a 19 mm roll and exposed to Isopar L for 24 hours. Little or no small transport molecule leaching was observed. Also, no film cracking was observed. The coated sample was subjected to a flat plate electrical scan and produced the following values: $V_o=820$ V; $V_R=10$ V.

EXAMPLE IV

An acrylic solution was made by mixing 1.0 g Dur-O-Cryl TM 820 (45% solids) and 0.3 g hydrolyzed $(MeO)_3Si(CH_2)_3N^+Me_3Cl^-$ (20% in a methanol/$H_2O$). A silicone hard coat solution was made by mixing 1.0 g SHCX1-2639 (20% solids in isopropanol), 1.0 g methanol, 0.1 g hydrolyzed $(MeO)_3Si(CH_2)_3N^+Me_3Cl^-$ (20% in a methanol/$H_2O$) and 0.02 g A-1100 catalyst. The acrylic solution was applied onto a sample of organic photoreceptor (containing N,N'-diphenyl-N,N'-bis(3-methylphenyl)-(1,1'-biphenyl)-4,4'-diamine) using a #5 Mayer rod. The polymer layer was air dried and then oven dried for 30 minutes at 85° C. The hard coat solution was then applied over the acrylic layer using a #22 Mayer rod. The hard coat layer was air dried, then cured for 1 hour at 86° C.

The resulting coated photoreceptor was stress tested against Isopar L. The prepared sample was bent over a 19 mm role and exposed to Isopar L for 24 hours. Little or no small transport molecule leaching was observed. Also, no film cracking was observed. The coated sample was subjected to a flat plate electrical scan and produced the following values: $V_o=840$ V; $V_R=10$ V.

What is claimed is:

1. A coated photorecptor element comprising a charge generation layer and a charge transport layer, wherein said charge transport layer comprises an aromatic amine transport molecule, wherein said transport layer is coated with a layer of a transport and conductive emulsion polymer that is unaffected by hydrocarbon solvents and that suppresses leaching of said transport molecule from said transport layer.

2. The element of claim 1 wherein said arylamine molecule is N,N'-diphenyl-N,N'-bis(3-methylphenyl)-(1,1'-biphenyl)-4,4'-diamine.

3. The element of claim 1 wherein said polymer layer comprises an acrylate polymer.

4. The element of claim 3 wherein said polymer layer comprises a crosslinked acrylic emulsion polymer.

5. The element of claim 1 wherein said polymer layer further comprises an ionic quaternary salt.

6. The element of claim 5 wherein said salt is trimethoxysilyl propyl-N,N,N-trimethyl ammonium chloride.

7. The element of claim 1 wherein said polymer layer is overcoated with a protective coating.

8. The element of claim 7 wherein said protective layer coating is a polysiloxane coating.

9. The element of claim 7 wherein said protective coating further comprises an ionic quaternary salt.

10. The element of claim 9 wherein said salt is trimethoxysilyl propyl-N,N,N-trimethyl ammonium chloride.

11. A coated photoreceptor element comprising a charge generation layer and a charge transport layer, wherein said charge transport layer comprises N,N'-diphenyl-N,N'-bis(3-methylphenyl)-(1,1'-biphenyl)-4,4'-diamine, wherein said transport layer is coated with a polymer layer comprising a mixture of a crosslinked acrylic emulsion polymer and trimethoxysilyl propyl-N,N,N-trimethyl ammonium chloride, and wherein said polymer layer is coated with an overcoat layer comprising a mixture of a polysiloxane and trimethoxysilyl propyl-N,N,N-trimethyl ammonium chloride.

* * * * *

UNITED STATES PATENT AND TRADEMARK OFFICE

CERTIFICATE OF CORRECTION

PATENT NO. :5,204,201
DATED :April 20,1993
INVENTOR(S) :Richard L. Schank, et al.

It is certified that error appears in the above-indentified patent and that said Letters Patent is hereby corrected as shown below:

| Column | Line | |
|---|---|---|
| 1 | 24 | Change "incorporaing" to --incorporating· |
| 2 | 12 | Change "4,40 ,4"-bis" to --4',4"-bis--. |
| 3 | 28 | Change "N+$Me_3$Cl-" to -- $N^+Me_3Cl^-$ --. |
| 4 | 15 | Change "N+$Me_3$Cl-" to -- $N^+Me_3Cl^-$ --. |
| 4 | 32 | Change "N+$Me_3$Cl-" to -- $N^+Me_3Cl^-$ --. |
| 4 | 35 | Change "N+$Me_3$Cl-" to -- $N^+Me_3Cl^-$ --. |
| 4 | 58 | Change "transport" to --transparent--. |
| 4 | 54 | Change "photorecptor" to --photoreceptor-· |

Signed and Sealed this

First Day of February, 1994

*Attest:*

Bruce Lehman

BRUCE LEHMAN

*Attesting Officer*

*Commissioner of Patents and Trademarks*